US011725426B2

(12) United States Patent
Nagata et al.

(10) Patent No.: US 11,725,426 B2
(45) Date of Patent: Aug. 15, 2023

(54) VEHICLE DOOR LOCKING DEVICE AND VEHICLE DOOR LOCKING SET

(71) Applicant: MITSUI KINZOKU ACT CORPORATION, Yokohama (JP)

(72) Inventors: Taichiro Nagata, Yokohama (JP); Yasuhiro Kubota, Yokohama (JP)

(73) Assignee: MITSUI KINZOKU ACT CORPORATION, Yokohama (JP)

( * ) Notice: Subject to any disclaimer, the term of this patent is extended or adjusted under 35 U.S.C. 154(b) by 111 days.

(21) Appl. No.: 16/620,479

(22) PCT Filed: Jun. 8, 2017

(86) PCT No.: PCT/JP2017/021269
§ 371 (c)(1),
(2) Date: Dec. 6, 2019

(87) PCT Pub. No.: WO2018/225205
PCT Pub. Date: Dec. 13, 2018

(65) Prior Publication Data

US 2021/0087859 A1 Mar. 25, 2021

(51) Int. Cl.
*E05B 77/06* (2014.01)
*E05B 63/00* (2006.01)
*E05B 85/14* (2014.01)

(52) U.S. Cl.
CPC ..... *E05B 77/06* (2013.01); *E05B 63/0056* (2013.01); *E05B 85/14* (2013.01)

(58) Field of Classification Search
CPC ..... E05B 77/02; E05B 77/04; E05B 77/06; E05B 63/0056; E05B 85/14; E05B 85/16;
(Continued)

(56) References Cited

U.S. PATENT DOCUMENTS

2005/0146147 A1* 7/2005 Niskanen ..... E05B 81/00 292/336.3
2012/0110920 A1 5/2012 Takagi et al.
(Continued)

FOREIGN PATENT DOCUMENTS

CN 102472057 A 5/2012
CN 106401323 A 2/2017
(Continued)

OTHER PUBLICATIONS

International Search Report for PCT Application No. PCT/JP2017/021269, dated Sep. 5, 2017 in 4 pages.

*Primary Examiner* — Christine M Mills
*Assistant Examiner* — Peter H Watson
(74) *Attorney, Agent, or Firm* — Knobbe, Martens, Olson & Bear, LLP

(57) ABSTRACT

A vehicle door locking device includes a case fixed to a door, a latch that locks a striker, a ratchet that holds the latch in the latching orientation, and shifts the latch from the latching orientation to the unlatching orientation, an outer handle lever that is rotated in conjunction with an opening operation, and an inertia part that maintains the orientation of the inertial part while being urged by an urging member, and that, when an external force from the one end side toward the other end side of the vehicle body, restricts rotation of the outer handle lever.

5 Claims, 8 Drawing Sheets

(58) Field of Classification Search
CPC ..... E05B 85/18; Y10T 292/1082; Y10T 292/1047; Y10T 292/57; Y10S 292/22; Y10S 292/23; Y10S 292/65
See application file for complete search history.

(56) References Cited

U.S. PATENT DOCUMENTS

| | | | | |
|---|---|---|---|---|
| 2013/0313036 | A1 * | 11/2013 | Kovie | E05B 77/06 180/274 |
| 2015/0240536 | A1 | 8/2015 | Cumbo | |
| 2017/0009493 | A1 | 6/2017 | Didier et al. | |

FOREIGN PATENT DOCUMENTS

| | | | | | |
|---|---|---|---|---|---|
| DE | 1678024 | B1 | | 8/1971 | |
| DE | 19511651 | A1 | | 10/1995 | |
| DE | 19511651 | A1 | * | 10/1995 | E05B 77/06 |
| DE | 102015002053 | A1 | | 8/2015 | |
| EP | 1512814 | A2 | * | 3/2005 | E05B 81/14 |
| EP | 3034723 | A1 | * | 6/2016 | E05B 77/06 |
| JP | 2004-204490 | A | | 7/2004 | |
| JP | 2011-26780 | A | | 2/2011 | |
| JP | 5948786 | B | | 5/2013 | |
| JP | 2013087454 | A | * | 5/2013 | |
| JP | 5849658 | B2 | | 6/2013 | |
| JP | 2014-510203 | A | | 4/2014 | |
| KR | 1449265 | B1 | * | 4/2013 | E05B 77/06 |
| WO | 2004011749 | A1 | | 2/2004 | |
| WO | WO-2004011749 | A1 | * | 2/2004 | E05B 77/06 |
| WO | WO-2013093092 | A1 | * | 6/2013 | E05B 85/16 |
| WO | 2014/111818 | A2 | | 7/2014 | |
| WO | WO-2017134756 | A1 | * | 8/2017 | B60J 5/00 |

* cited by examiner

VEHICLE DOOR LOCKING DEVICE AND VEHICLE DOOR LOCKING SET

CROSS-REFERENCE TO RELATED APPLICATIONS

This application is the U.S. National Phase under 35. U.S.C. § 371 of International Application PCT/JP2017/021269, filed Jun. 8, 2017. The disclosures of the above-described application are hereby incorporated by reference in their entirety.

TECHNICAL FIELD

The present invention relates to a vehicle door locking device and a vehicle door locking set.

BACKGROUND ART

For example, Patent Document 1 discloses a vehicle door latch device including a housing, a fork (a latch), a pole (a ratchet), an open lever, and a control lever provided with an inertia lever (see FIGS. 2, 3, 5, and 6 of Patent Document 1). Here, the inertia lever is disposed above the open lever. An inertia force larger than a set value acts on the inertia lever so that the inertia lever swings from a first position to a second position and comes into contact with the housing, whereby one or more levers from among the open lever and the control lever is restricted.

In addition, Patent Document 2 discloses a vehicle door latch device including a latch capable of engaging with a striker, a ratchet capable of mating with the latch, an open lever for causing an operation to release the ratchet, and an impact release preventive mechanism that is disposed below the ratchet and that inhibits rotation of the ratchet in order to prevent a door from opening when the open lever is rotated at an excessive speed due to a collision accident, etc. Here, the impact release preventive mechanism is formed of a movable element having an influence on operation of the ratchet.

CITATION LIST

Patent Literature

Patent Document 1: JP5948786B
Patent Document 2: JP2016-505098 (WO2014/111818)

SUMMARY OF INVENTION

Technical Problem

However, for each of the vehicle door latch devices disclosed in Patent Documents 1 and 2, there is a possibility that a failure may occur during the motion of an inertia lever due to dust or water that enters through a striker intrusion and that may remain and adhere to the inertia lever.

In view of the above problem, an object of the present invention is to provide a vehicle door locking device in which a failure may occur during motion of an inertia lever is can be reduced.

Solution to Problem

A first vehicle door locking device of the present invention includes: a case fixed to a door that opens and closes an opening on one end side in a width direction of a vehicle body; a latch that is swingable relative to the case, that locks a striker fixed to the vehicle body when having a latching orientation in conjunction with opening and closing of the door, and that releases the locking when being shifted from the latching orientation to an unlatching orientation; a ratchet that is swingable relative to the case, that, when having a first orientation, comes into contact with the latch and holds the latch in the latching orientation, and that, when being shifted from the first orientation to a second orientation, leaves the latch and shifts the latch from the latching orientation to the unlatching orientation; an outer handle lever that is swingably supported by the case, that is connected to an outer handle, and that is rotated in conjunction with an opening operation of the outer handle; and an inertia part that is swingably supported at a lower portion of the outer handle lever in the case, that maintains the orientation thereof in contact with the case while being urged by an urging member, and that, when an external force of a predetermined magnitude or larger acts thereon from the one end side toward the other end side, the orientation of the case is charged by an inertia force caused by the external force, and thereby restricts rotation of the outer handle lever.

In a second vehicle door locking device of the present invention according to the above vehicle door locking device, an other vehicle door locking device is disposed in an opening on the other end side in the width direction of the vehicle body, the other vehicle door locking device including: an other case fixed to an other door that opens and closes the opening on the other end side; an other latch that is swingable relative to the other case, that locks a striker fixed to the vehicle body when having a latching orientation in conjunction with opening and closing of the other door, and that releases the locking when being shifted from the latching orientation to an unlatching orientation; an other ratchet that is swingable relative to the other case, that, when having a first orientation, comes into contact with the other latch and holds the other latch in the latching orientation, and that, when being shifted from the first orientation to a second orientation, leaves the other latch and shifts the other latch from the latching orientation to the unlatching orientation; an other outer handle lever that is swingably supported by the other case, that is connected to an other outer handle, and that is rotated in conjunction with an opening operation of the other outer handle; and an other inertia part that is swingably supported at a lower portion of the other outer handle lever in the other case, that maintains the orientation thereof in contact with the other case while being urged by an other urging member, and that, when an external force of a predetermined magnitude or larger acts thereon from the other end side toward the one end side, the orientation of the case is changed by an inertia force caused by the external force, and thereby restricts rotation of the other outer handle lever. The inertia part and the other inertia part include respective swing shafts, respective inertia levers each swingable about a position other than the center of gravity, and respective weights attached to the inertia levers, such that the swing shafts, the inertia levers, and the weights respectively have the same shapes. The inertia part and the other inertia part are different from each other as regards attachment positions of the weights on the corresponding inertia levers.

In a third vehicle door locking device of the present invention according to the above vehicle door locking device, the inertia part has a symmetric relationship with the other inertia part, when viewed from a longitudinal direction of the vehicle body.

In a fourth vehicle door locking device of the present invention according to the above vehicle door locking device, the case, the latch, the ratchet, and the outer handle lever have symmetric relationships with the other case, the other latch, the other ratchet, and the other outer handle lever, respectively, when viewed from a longitudinal direction of the vehicle body.

A vehicle door locking set of the present invention includes: any one of the first to fourth vehicle door locking device; and other vehicle door locking device disposed in an opening on the other end side in the width direction of the vehicle body, the other vehicle door locking device including an other case fixed to an other door that opens and closes the opening on the other end side, an other latch that is swingable relative to the other case, that locks a striker fixed to the vehicle body when having a latching orientation in conjunction with opening and closing of the other door, and that releases the locking when being shifted from the latching orientation to an unlatching orientation, an other ratchet that is swingable relative to the other case, that, when having a first orientation, comes into contact with the other latch and holds the other latch in the latching orientation, and that, when being shifted from the first orientation to a second orientation, leaves the other latch and shifts the other latch from the latching orientation to the unlatching orientation, an other outer handle lever that is swingably supported by the other case, that is connected to an other outer handle, and that is rotated in conjunction with an opening operation of the other outer handle, and an other inertia part that is swingably supported at a lower portion of the other outer handle lever in the other case, that maintains the orientation thereof in contact with the other case while being urged by an other urging member, and that, when an external force of a predetermined magnitude or larger acts thereon from the other end side toward the one end side, the orientation of the case is changed by an inertia force caused by the external force, and thereby restricts rotation of the other outer handle lever.

Advantageous Effects of Invention

In the vehicle door locking device of the present embodiment, the possibility that failure may occur during motion of the inertia lever can be reduced. Further, in the vehicle door locking set of the present embodiment, the possibility that failure may occur during motion of the respective inertia levers of the vehicle door locking device and the other vehicle door locking device can be reduced.

DESCRIPTION OF EMBODIMENT

<Outline>

Hereinafter, vehicle door locking set 10 (see FIGS. 1 and 2B, etc.) of the present embodiment is described with reference to the drawings. First, the configuration of vehicle door locking set 10 is described. Next, operations of vehicle door locking set 10 of the present embodiment are described. Next, effects of vehicle door locking devices 10A, 10B (see FIGS. 1 and 2B, etc.) and vehicle door locking set 10 of the present embodiment are described.

Vehicle door locking set 10 (hereinafter, referred to as door locking set 10) of the present embodiment has a function of locking, relative to vehicle body CB (see FIG. 1), doors LD, RD that respectively open and close openings AP1, AP2 (see FIG. 1) which are disposed on both end sides in the width direction of vehicle body CB (see FIG. 1). Door LD refers to left side door LD, and door RD refers to right side door RD herein. Note that, herein, openings AP1, AP2 are disposed on the front side (on the front seat side) of vehicle body CB which configures a vehicle having two-row seats. That is, door locking set 10 of the present embodiment is for front doors of vehicle body CB, i.e., for front locking.

Figure 1:
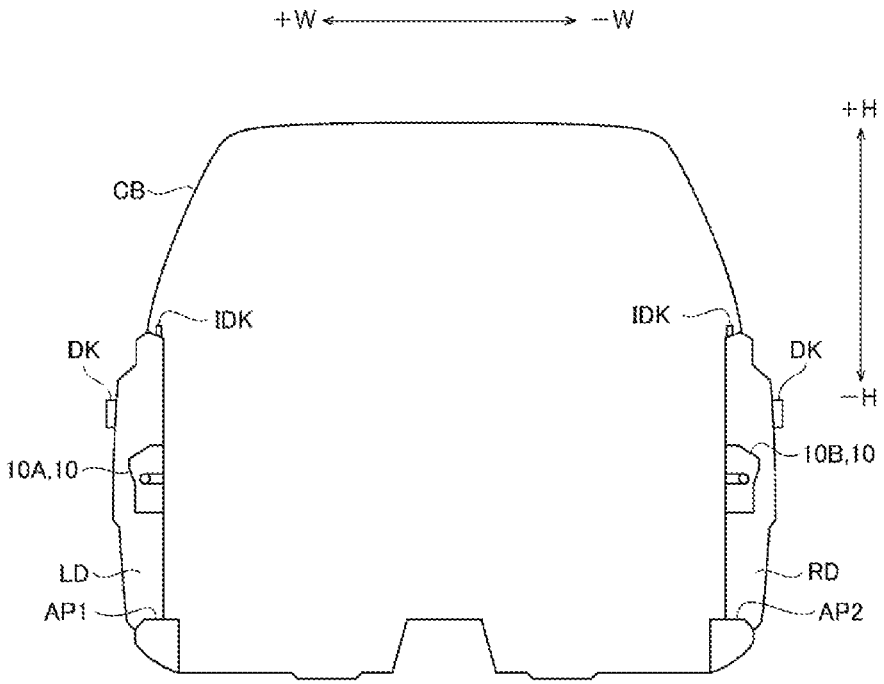
FIG. 1 is a cross-sectional view in which a part of a vehicle having a vehicle door locking set of an embodiment of the present invention (hereinafter, referred to as a present embodiment) attached thereto is viewed from the rear side in the longitudinal direction of the vehicle.
Figure 2A:
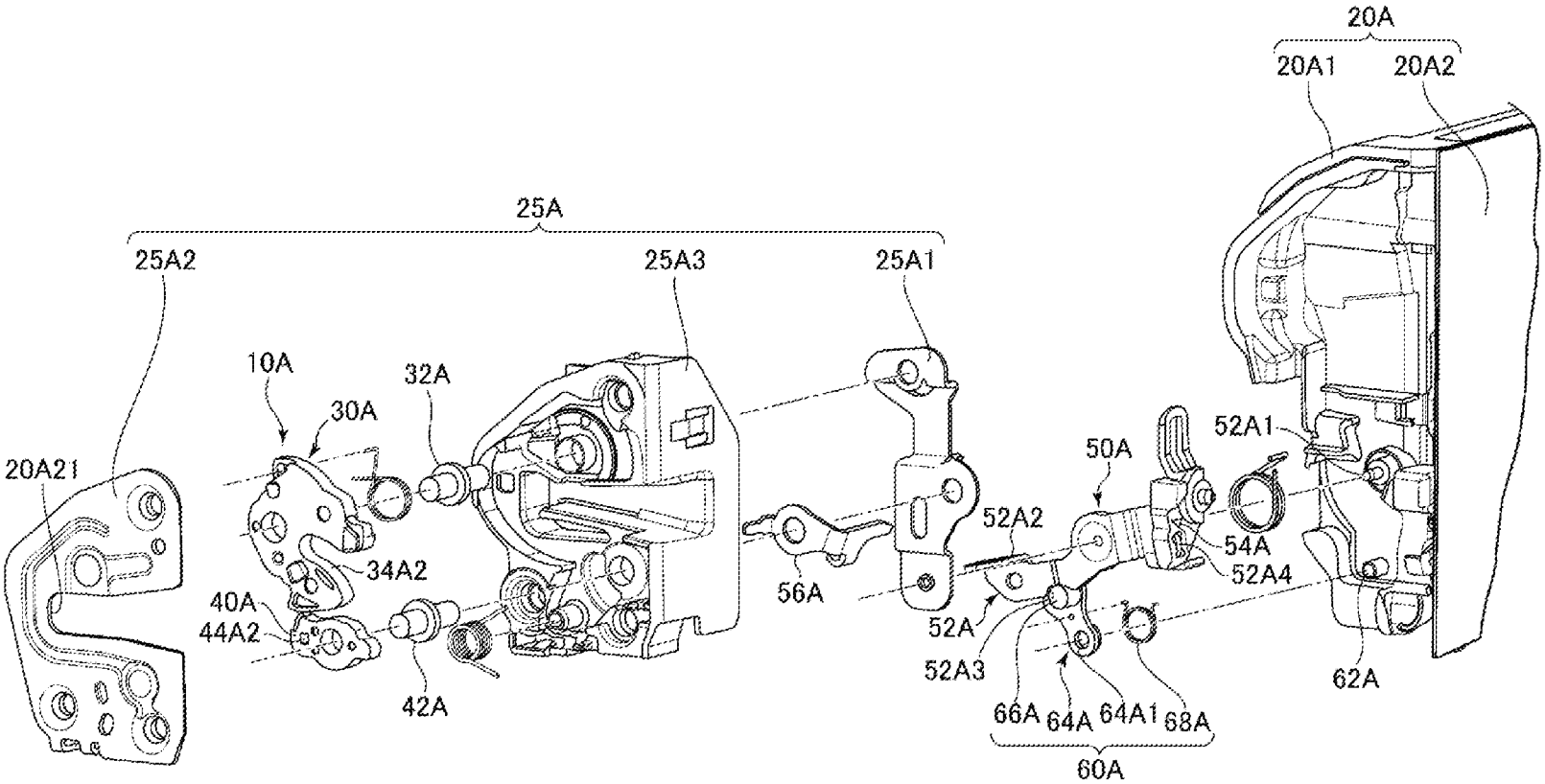
FIG. 2A is an exploded perspective view of a left door locking device included in the vehicle door locking set of the present embodiment.
Figure 2B:
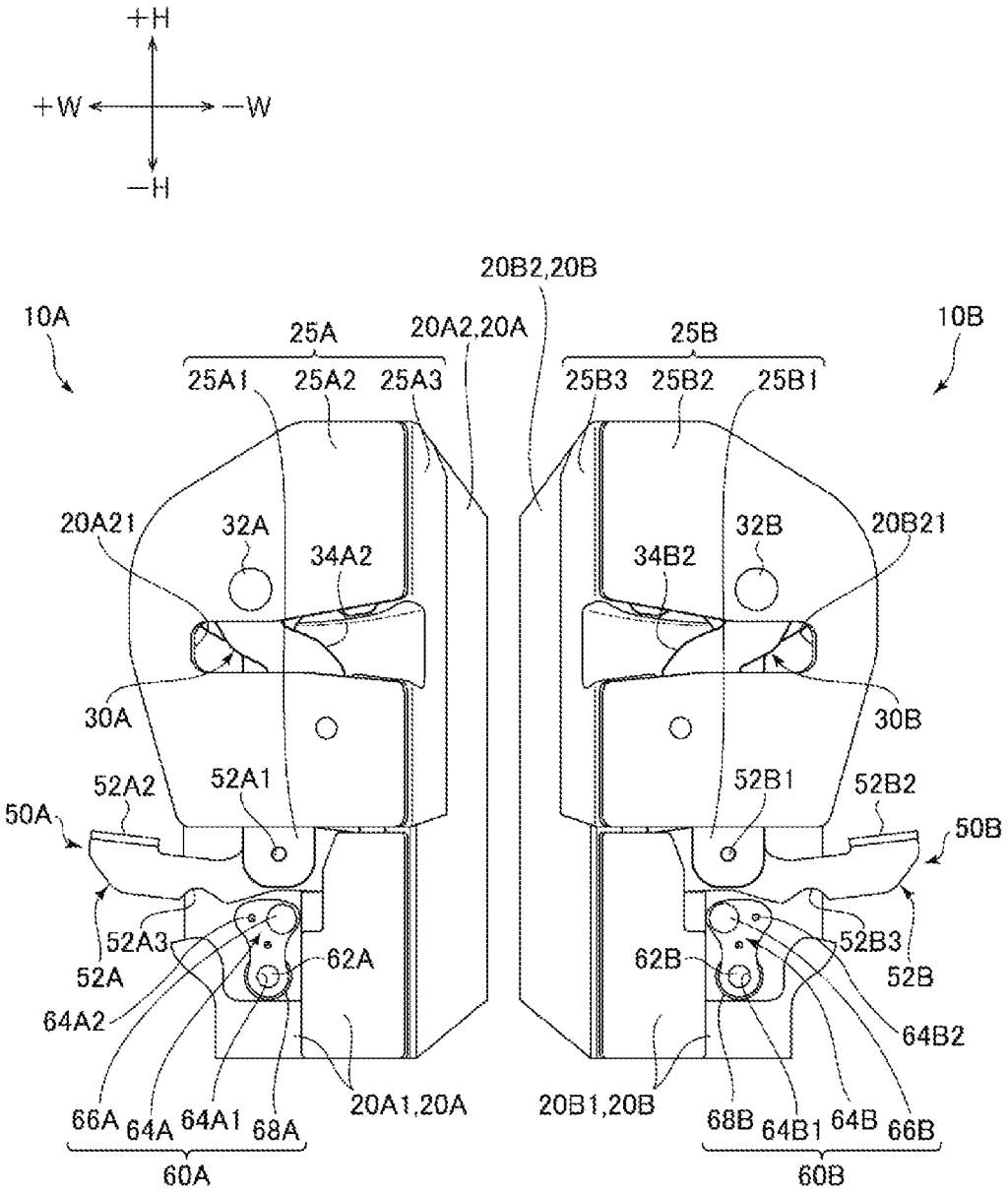
FIG. 2B is a diagram (a front view) in which the vehicle door locking set of the present embodiment is viewed from the rear side in the longitudinal direction of the vehicle.

Further, as illustrated in FIGS. 1 and 2B, door locking set 10 of the present embodiment includes door locking device 10A (hereinafter, referred to as left side device 10A) for left door LD and door locking device 10B (hereinafter, referred to as right side device 10B) for right door RD. Here, left side device 10A is one example of a vehicle door locking device. Right side device 10B is one example of the other vehicle door locking device. Left side device 10A and right side device 10B are attached to left door LD and right door RD, respectively, and have functions for holding closed states (engaged states) of left door LD and right door RD relative to vehicle body CB, respectively.

Moreover, in the present embodiment, left side device 10A and right side device 10B are configured to be substantially symmetric to each other. In the explanation below, the configuration of left side device 10A is first described. Next, the difference in configuration between right side device 10B and left side device 10A is described.

Note that, in the present embodiment, the width direction of vehicle body CB (or the vehicle) is denoted by reference character W. One end side in the width direction (the left side in the width direction) is denoted by reference character +W, and the other end side (the right side) is denoted by reference character −W. The height direction of vehicle body CB (or the vehicle) is denoted by reference character H. The upper side in the height direction is denoted by reference character +H, and the lower side in the height direction is denoted by reference character −H.

<Left Side Device>

As illustrated in FIGS. 2A to 5B, left side device 10A of the present embodiment includes housing 20A, latch mechanism 25A, ratchet operating mechanism 50A, and inertia part 60A.

[Housing]

As illustrated in FIG. 2A, housing 20A of the present embodiment includes case 20A1 and cover 20A2, and is fixed to the left door LD side. Latch mechanism 25A is attached to an upper portion of case 20A1. Swing shaft 52A1 which swingably supports outer handle lever 52A (described later) is fixed to a lower portion of case 20A1. Specifically, swing shaft 52A1 is fixed to case 20A1, with a screw (not illustrated) from the opposite side of back plate 25A1 (described later) such that case 20A1 is interposed therebetween. Further, in case 20A1, swing shaft 62A for swingably supporting inertia part 60A (described later) is fixed to a portion lower than the portion where swing shaft 52A1 is fixed.

As illustrated in FIGS. 2A and 2B, cutout 20A21 extending in the width direction from the right end is formed in cover plate 25A2. In conjunction with an opening/closing operation from an open state to a closed state of left door LD, striker ST (see FIGS. 3 to 5B) that is fixed to an opening edge, on the left side in the width direction of vehicle body CB, enters the inner side portion of cutout 20A21. In the explanation below, FIGS. 3, 4, 5, 5A, 5B, and 5C are front views.

[Latch Mechanism]

As illustrated in FIG. 2A, latch mechanism 25A of the present embodiment includes latch 30A, ratchet 40A, back plate 25A1, cover plate 25A2, and body 25A3, and swing shafts 32A, 42A. Latch 30A and ratchet 40A are swingably supported by swing shafts 32A, 42A, respectively. In latch mechanism 25A, a unit is formed by arranging latch 30A, ratchet 40A, and body 25A3 between back plate 25A1 and cover plate 25A2 and by caulking both ends of swing shaft 32A and both ends of swing shaft 42A on back plate 25A1 and cover plate 25A2, respectively. That is, latch mechanism 25A that forms the unit is attached to case 20A1.

[Latch]

Latch 30A of the present embodiment has a function of locking striker ST when having a latching orientation and when releasing locking of striker ST to an unlatching orientation from the latching orientation, in conjunction with opening/closing of left door LD. Here, the term "locking" means positioning an object while being in contact with the object. Thus, the expression "releasing locking" meanskeeping an object that is to be shifted in a state in which the object is not positioned. Moreover, the term "latching orientation" means an orientation (see the orientation of latch 30A in left side device 10A in FIG. 3) in the state (an engaged state) where latch 30A locks striker ST. The term "unlatching orientation" means an orientation (see the orientation of latch 30A in left side device 10A in FIG. 4) in the state (an engagement released state) where locking of striker ST by latch 30A is released.

As described above and as illustrated in FIGS. 2A and 3 to 5B, latch 30A of the present embodiment is swingably supported by swing shaft 32A that is caulked on back plate 25A1 and cover plate 25A2. That is, latch 30A of the present embodiment is swingable relative to case 20A1. In addition, recess 34A2 recessed from the outer circumferential side toward through hole 34A1 side is formed in the outer circumference of latch 30A.

Moreover, a torsion coil spring (not illustrated) is disposed in the outer circumference of swing shaft 32A. One end portion of the torsion coil spring is fixed to body 25A3, and the other end portion is fixed to latch 30A. The orientation of latch 30A is determined while being held by ratchet 40A (described later) in a state of being always urged in a counterclockwise direction by the torsion coil spring when viewed from the front.

[Ratchet]

Ratchet 40A of the present embodiment has a function of, when having a first orientation, coming into contact with latch 30A and holding latch 30A, and of, when being shifted from the first orientation to a second orientation, leaving latch 30A and shifting the orientation of latch 30A from the latching orientation to the unlatching orientation. Here, the term "first orientation" means an orientation for holding latch 30A in the latching orientation (see the orientation of ratchet 40A of left side device 10A in FIG. 3). The term "second orientation" means an orientation for making latch 30A swingable in the counterclockwise direction, when viewed from the front, by leaving latch 30A in the latching orientation (see the orientation of ratchet 40A of left side device 10A in FIG. 4).

As illustrated in FIGS. 2A and 3 to 5B, ratchet 40A of the present embodiment is disposed at the lower right side (the right and lower side) relative to latch 30A, when viewed from the front. In addition, as described above, ratchet 40A of the present embodiment is swingably supported by swing shaft 42A that is caulked on back plate 25A1 and cover plate 25A2. That is, ratchet 40A of the present embodiment is swingable relative to case 20A1.

Figure 3:
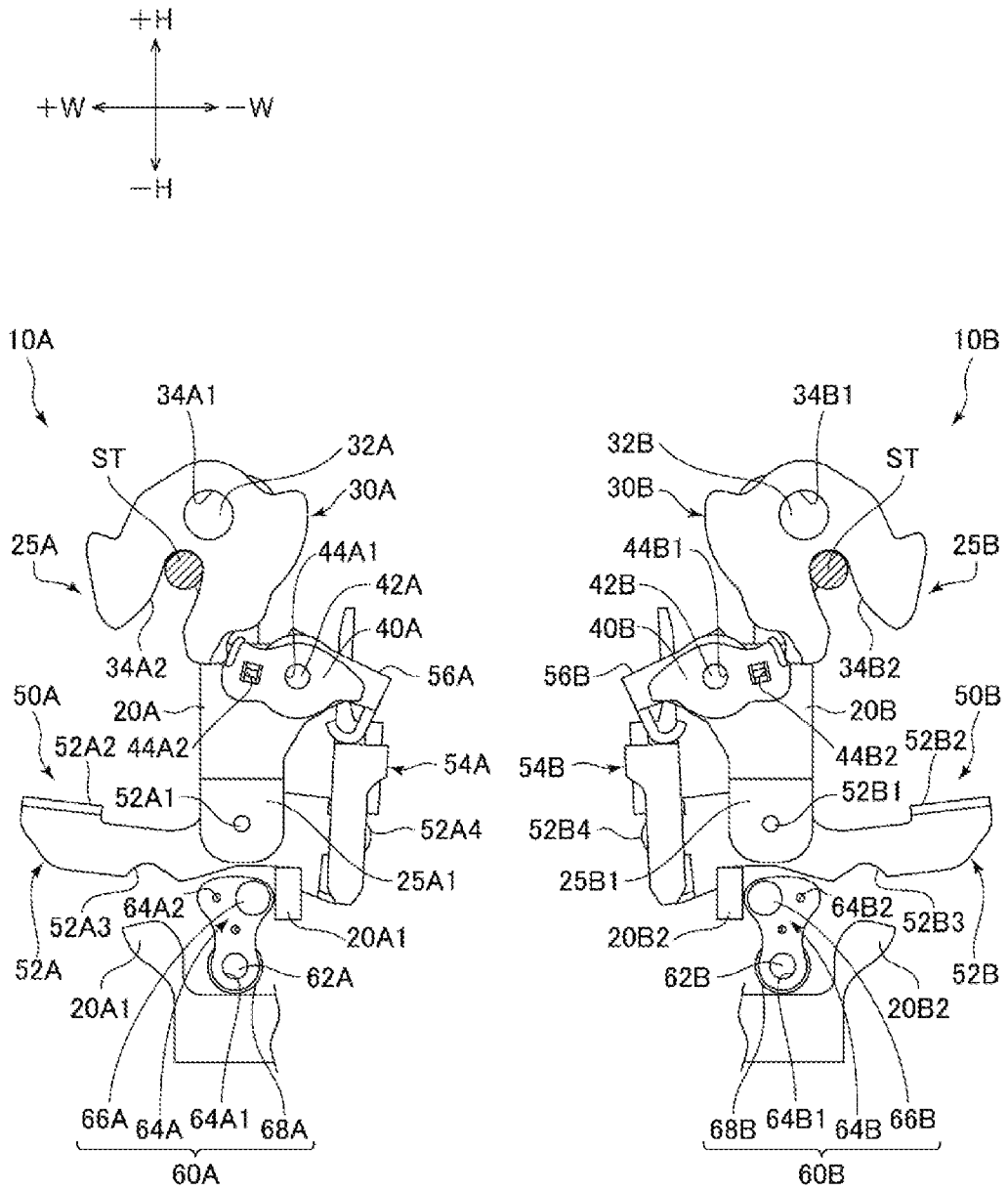
FIG. 3 is a front view of main components forming the vehicle door locking set of the present embodiment wherein a right door and a left door are each in an engaged state.
Figure 4:
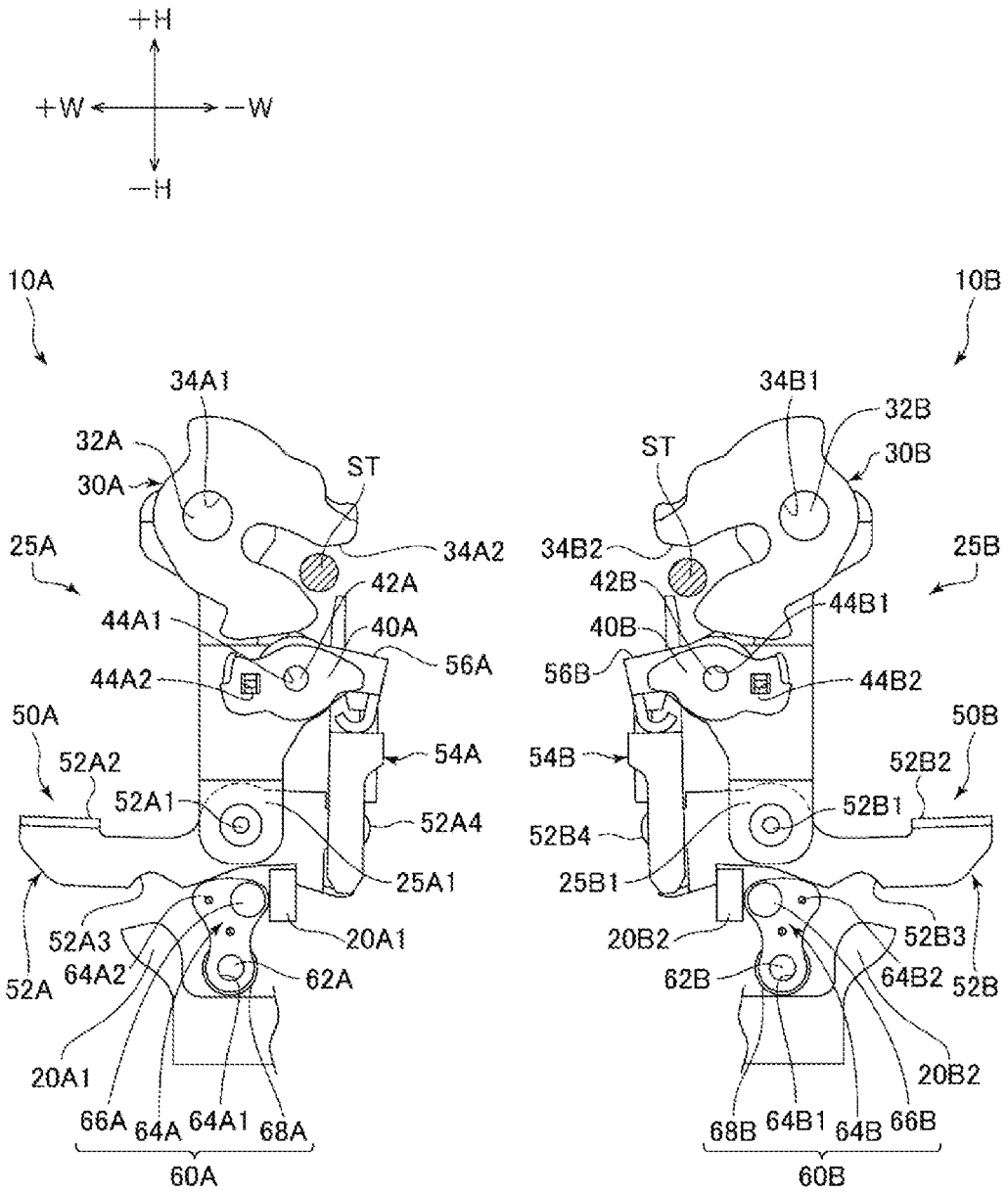
FIG. 4 is a front view of the main components forming the vehicle door locking set of the present embodiment wherein the right door and the left door are each in an engagement released state.

As illustrated in FIG. 3, when having an orientation (the first orientation) in which ratchet 40A is being pressed by latch 30A with one end, in the longitudinal direction of ratchet 40A, of ratchet 40A in contact with latch 30A, ratchet 40A holds latch 30A in the latching state. Further, as illustrated in FIG. 4, ratchet 40A swings counterclockwise from the first orientation (see the orientation of ratchet 40A of left side device 10A in FIG. 3) such that the one end, in the longitudinal direction of ratchet 40A, of ratchet 40A leaves latch 30A (ratchet 40A is shifted to the second orientation), whereby latch 30A is caused to swing counterclockwise, when viewed from the front. Accordingly, latch 30A is shifted to the unlatching orientation.

Ratchet 40A has formed therein a through hole 44A2 into which a part of lever ratchet 56A (see FIGS. 2A and 3 to 5A) of ratchet operating mechanism 50A (described later) is inserted. In conjunction with orientation change of lever ratchet 56A, ratchet 40A rotates integrally with lever ratchet 56A.

[Ratchet Operating Mechanism]

Ratchet operating mechanism 50A of the present embodiment is connected to an outer handle (not illustrated). Ratchet operating mechanism 50A has a function for shifting the orientation of ratchet 40A from the first orientation to the second orientation as a result of rotation of the outer handle lever 52A (described later) by an opening operation of the outer handle.

As illustrated in FIGS. 2A and 3 to 5B, ratchet operating mechanism 50A of the present embodiment includes outer handle lever 52A, open link 54A, and lever ratchet 56A. Ratchet operating mechanism 50A is configured such that outer handle lever 52A connected with open link 54A rotates to move open link 54A in the height direction. Lever ratchet 56A is configured to rotate when being pushed by open link 54A that has moved upward from the normal position (see FIG. 3).

Outer handle lever 52A of the present embodiment has a function of directly receiving a force of the outer handle (not illustrated). As illustrated in FIGS. 2A and 3 to 5B, outer handle lever 52A is disposed below ratchet 40A, when viewed from the front. Outer handle lever 52A, which is long, is swingably supported, at the center in the longitudinal direction thereof, by swing shaft 52A1 that is fixed to case 20A1 and fitted in back plate 25A1. In addition, outer handle lever 52A normally (when not being pushed by the outer handle) has an orientation substantially along the width direction of vehicle body CB. In a counterclockwise direction relative to case 20A1, when viewed from the front, outer handle lever 52A is always urged by a torsion coil spring (not illustrated).

Here, the outer handle (not illustrated) is connected with an open member (not illustrated). The open member is connected with left end 52A2 of outer handle lever 52A, when viewed from the front. In conjunction with an opening operation of the outer handle, outer handle lever 52A swings at a predetermined angle about swing shaft 52A1. Here, the predetermined angle is set to 10° as one example. As illustrated in FIGS. 3 to 5, recess 52A3 having a shape recessed upward is formed in a portion on the left side relative to a portion to which swing shaft 52A1 is fixed on the outer handle lever 52A, when viewed from the front. Further, in the explanation below, an end opposite to left end 52A2 of outer handle lever 52A is defined as right end 52A4.

Open link 54A of the present embodiment has a function of transmitting, to lever ratchet 56A at a time of unlocking, a force which outer handle lever 52A directly receives from the outer handle (not illustrated). A through hole (not illustrated) is formed in a lower portion of open link 54A, and right end 52A4 of outer handle lever 52A is engaged in the through hole. When open link 54A moves in the height direction from the normal position thereof (see FIG. 3) as a result of rotation of outer handle lever 52A, lever ratchet 56A rotates by being pushed by open link 54A that has moved upward from the normal position.

As illustrated in FIGS. 2A and 3 to 5B, lever ratchet 56A of the present embodiment is a member positioned directly above open link 54A.

As described above, when outer handle lever 52A is rotated counterclockwise from the normal position (see FIG. 3) by an opening operation of the outer handle, open link 54A engaging with right end 52A4 of outer handle lever 52A is moved upward, and further, lever ratchet 56A pushed by open link 54A in conjunction with the upward movement of open link 54A swings counterclockwise about swing shaft 42A of ratchet 40A, when viewed from the front. When ratchet operating mechanism 50A is rotated at the predetermined angle or larger in conjunction with the opening operation of the outer handle and the orientation of ratchet 40A is shifted from the first orientation to the second orientation, latch 30A having the latching orientation leaves ratchet 40A and receives a seal reaction force of left door LD, whereby the orientation of latch 30A is shifted to the unlatching orientation.

[Inertia Part]

Inertia part 60A of the present embodiment has a function of, when an external force of a predetermined magnitude or larger acts on vehicle body CB from the left side to the right side in the width direction of vehicle body CB, restricting motion of outer handle lever 52A and motion of an open link 54A of ratchet operating mechanism 50A upon orientation change of inertia part 60A by an inertia force caused by the external force. Here, one example of an external force of the predetermined magnitude or larger is an external force of 15G or larger.

As described above, inertia part 60A of the present embodiment is swingably supported by swing shaft 62A which is fixed to a portion, in case 20A1, below swing shaft 52A1 that supports outer handle lever 52A. That is, inertia part 60A of the present embodiment is disposed below outer handle lever 52A (at a lower portion of ratchet operating mechanism 50A), as illustrated in FIGS. 2A to 5B. Also, inertia part 60A includes inertia lever 64A, weight 66A, and torsion coil spring 68A, as illustrated in FIGS. 2A to 5B. Here, torsion coil spring 68A is one example of an urging member having a function of urging inertia lever 64A.

Inertia lever 64A is a member having, when viewed from the front, an isosceles trapezoid shape which is long in the height direction thereof and the four corners of which are largely round chamfered. Through hole 64A1 is formed at a side having the narrower width in the longitudinal direction thereof. Further, inertia lever 64A is fixed to case 20A1, that is, is swingably supported by swing shaft 62A which is integrated with case 20A1. Inertia lever 64A is supported, at a position other than the gravity center thereof, by swing shaft 62A so as to be swingable about swing shaft 62A. That is, inertia lever 64A is swingable with the axis set at the position other than the gravity center. Moreover, weight 66A is attached to a portion which is on a side, of inertia lever 64A, opposite, in the longitudinal direction, to the side where swing shaft 62A is fixed, and which is a portion on one side in the lateral direction. Specifically, a pair of through holes 64A2 are formed on both sides, in the lateral direction, of the opposite side portion of inertia lever 64A, and weight 66A is fixed in through hole 64A2 on the right side (the inner side in the width direction of vehicle body CB), when viewed from the front, of the pair of through holes 64A2.

Torsion coil spring 68A is disposed in the outer circumference of swing shaft 62A positioned between inertia lever 64A and case 20A1. One end portion of torsion coil spring 68A is fixed to case 20A1, and the other end portion is fixed to inertia lever 64A. As illustrated in FIGS. 2B, 3, and 4, the orientation of inertia lever 64A is determined by being in contact with case 20A1 while always being urged in a clockwise direction by torsion coil spring 68A (while being urged from the left side to the right side in the width direction of vehicle body CB), when viewed from the front. Specifically, inertia lever 64A normally (when an inertia force toward the width direction of vehicle body CB does not act on inertia lever 64A, see FIG. 2B) maintains the orientation thereof in a state where the side of inertia lever 64A to which swing shaft 62A is fixed is set to the lower side and inertia lever 64A is inclined rightward, when viewed from the front. When viewed from the front, weight 66A is fixed to a right portion relative to the center in the lateral direction of inertia lever 64A, as illustrated in FIGS. 2B to 5B.

Accordingly, it can be said that inertia lever 64A (inertia part 60A) of the present embodiment is swingably supported at a lower portion of outer handle lever 52A in case 20A1. For example, when an external force of the predetermined magnitude or larger acts from the left side, relative to inertia lever 64A, to the right side in the width direction due to a certain cause, an inertia force caused by the external force causes inertia lever 64A of the present embodiment to swing at the predetermined angle counterclockwise when viewed form the front. Weight 66A of inertia part 60A is set such that, in a case where inertia lever 64A has the normal orientation (see FIG. 3), weigh 66A does not to come into contact with outer handle lever 52A (see FIGS. 2B, 3, and 4) even when outer handle lever 52A is rotated from the normal position (see FIG. 3) counterclockwise to the maximum set rotation limit by an opening operation of the outer handle (not illustrated). In contrast, when inertia lever 64A has an orientation different from the normal orientation after swinging counterclockwise at a predetermined angle due to the inertia force caused by the external force, inertia part 60A is set so as to come into contact with outer handle lever 52A that has not rotated at a predetermined angle and to restrict rotation of outer handle lever 52A at the predetermined angle or larger (see FIG. 5B). Outer handle lever 52A and inertia lever 64A deviate from each other in the longitudinal direction. Inertia lever 64A is set so as not to come into contact with outer handle lever 52A that is swinging.

As described above, an external force of the predetermined magnitude or larger is an external force of 15G or larger as one example. However, an inertia force caused by the external force can be adjusted according to the type (the size, the weight, etc.) of weight 66A and the type (the spring constant, etc.) of torsion coil spring 68A. That is, in inertia part 60A of the present embodiment, an inertia force thereof can be adjusted by a change in the types of either or both of weight 66A and torsion coil spring 68A.

<Right Side Device>

Next, differences between right side device 10B and left side device 10A are described with reference to the drawings.

As illustrated in FIGS. 2B, 3, 4 and 5C, right side device 10B of the present embodiment includes housing 20B, latch mechanism 25B, ratchet operating mechanism 50B, and inertia part 60B. Latch mechanism 25B includes latch 30B, ratchet 40*b*, back plate 2561, cover plate 2562, body 2563, and swing shafts 32B, 42B. Here, housing 20B is one example of the other housing, latch 30B is one example of the other latch, ratchet 40B is one example of the other ratchet, ratchet operating mechanism 50B is one example of the other ratchet operating mechanism, and inertia part 60B is one example of the other inertia part.

As illustrated in FIGS. 2B, 3, and 4, housing 20B, latch mechanism 25B, ratchet operating mechanism 50B, inertia part 60B, and a torsion coil spring (not illustrated) which urges these components have mirror-image relationships, when viewed from the front, with housing 20A, latch 30A, latch mechanism 25A, ratchet operating mechanism 50A, inertia part 60A, and the torsion coil spring (not illustrated) which urges these components, respectively. That is, housing 20B, (latch 30B and ratchet 40B included in) latch mechanism 25B, ratchet operating mechanism 50B, inertia part 60B, and the torsion coil which urges these components have symmetric relationships, when viewed from the front (when viewed from the longitudinal direction of vehicle body CB), with housing 20A, (latch 30A and ratchet 40A included in) latch mechanism 25A, ratchet operating mechanism 50A, inertia part 60A, and the torsion coil spring which urges these components, respectively. Torsion coil spring 68B (see FIGS. 3 and 4, etc.) which has a symmetric relationship with torsion coil spring 68A is one example of the other urging member.

The reference characters of the components of right side device 10B and sections of the components are defined by replacing "A" of the corresponding components and sections of left side device 10A with "B" (see FIGS. 1 to 5C). For example, a recess formed in latch 30B included in right side device 10B is defined as recess 3462. However, since right side device 10B has the mirror-image relationship with left side device 10A as described above, left end 52A2 of outer handle lever 52A included in left side device 10A corresponds to right end 52E32 of outer handle lever 52B included in right side device 10B.

Further, the relationship between inertia part 60A and inertia part 60B is as follows. That is, inertia lever 64B having weight 66B attached thereto is realized by inverting inertia lever 64A and attaching weight 66A from the rear surface side similarly into through hole 64A2 into which weight 66A is attached. Inertia lever 64B may be realized by attaching weight 66A to through hole 64A2 without inverting inertia lever 64A.

The configuration of door locking set 10 has been described above.

<Operations>

Next, operations of door locking set 10 (left side device 10A and right side device 10B) of the present embodiment are described with reference to the drawings. First, an operation when an occupant opens left door LD (right door RD) in normal use of the vehicle is described. Next, an operation when a side collision is generated from left door LD side or right door RD side relative to the vehicle.

[Operation when an Occupant Opens Left Door LD (Right Door RD) in Normal Use of the Vehicle]

First, just for the purpose of changing the orientation of open link 54A of left door LD, an occupant establishes an unlocked state and performs an opening operation (a door opening operation) on the outer handle (not illustrated). Accordingly, outer handle lever 52A rotates from the normal position (see FIG. 3) counterclockwise when viewed from the front, open link 54A engaged with right end 52A4 of outer handle lever 52A moves upward, and further, lever ratchet 56A being pushed by open link 54A that has moved upwardly swings counterclockwise about swing shaft 42A of ratchet 40A. In conjunction with this, the orientation of ratchet 40A is shifted from the first orientation to the second orientation, latch 30A in the latching orientation leaves ratchet 40A and receives a force due to a seal reaction force of left door LD, whereby the orientation of latch 30A is shifted to the unlatching orientation (see FIG. 4). As a result, the locking of striker ST by latch 30A is released, and the occupant pulls left door LD to the outside (the left side) in the width direction of vehicle body CB, whereby the occupant successfully opens left door LD.

The operation to open right door RD is as follows. That is, in conjunction with the same operation of right side device 10B as that of left side device 10A, latch 30B in the latching orientation is shifted to the unlatching orientation. As a result, the occupant pulls right door RD to the outside (the right side) in the width direction of vehicle body CB, whereby the occupant successfully opens right door RD.

[Operation when a Side Collision is Generated from the Left Door Side Relative to the Vehicle]

Hereinafter, an operation of left side device 10A when a side collision is generated from left door LD side relative to the vehicle is described with reference to the drawings.

When an external force of the predetermined magnitude or larger acts on vehicle body CB from the left side to the right side relative to vehicle body CB as a result of a side collision generated from left door LD side, an inertia force caused by the external force acts, in a direction opposite to that of the external force, on inertia part 60A (see FIG. 3) that is positioned in the normal orientation. In conjunction with this, inertia lever 64A is rotated at a predetermined angle about the shaft so that the orientation of inertia lever 64 is shifted from the normal orientation in FIG. 3 to the orientation in FIG. 5A. Therefore, even when outer handle lever 52A swings through the deformation caused by the side collision, outer handle lever 52A comes into contact with weight 66A of inertia part 60A whose the orientation of which has been changed by the inertia force, and thus, cannot rotate at the predetermined angle or larger (FIG. 5B). Accordingly, since outer handle lever 52A cannot shift the orientation of ratchet 40A to the second orientation, latch 30A cannot swing while locking striker ST (while staying in the latching orientation). In this way, when a side collision is generated from the left door LD side relative to the vehicle, left side device 10A prevents left door LD from opening.

[Operation when a Side Collision is Generated from the Right Door Side Relative to the Vehicle]

An operation of right side device 10B when a side collision is generated from the right door RD side relative to the vehicle, is the same as the aforementioned operation of left side device 10A. That is, when an external force of the predetermined magnitude or larger acts, from the right side to the left side in the width direction of the vehicle body CB, on vehicle body CB as a result of a side collision generated from the right door RD side, an inertia force caused by the external force acts, in a direction opposite to that of the external force, on inertia part 60B that is positioned in the normal orientation (see FIG. 3). In conjunction with this, inertia lever 64B is rotated at the predetermined angle about the shaft by the inertia force so that the orientation of inertia lever 64B is shifted from the normal orientation in FIG. 3 to the orientation in FIG. 5C. As a result, outer handle lever 52B cannot shift the orientation of ratchet 40B to the second orientation on the basis of the same mechanism as that in left side device 10A, and thus, latch 30B cannot swing while locking striker ST (while staying in the latching orientation). In this way, when a side collision is generated from right door RD side relative to the vehicle, right side device 10B prevents right door RD from opening.

The operations of door locking set 10 (left side device 10A and right side device 10B) of the present embodiment have been described above.

<Effects>

Hereinafter, effects of door locking set 10 and left side device 10A of the present embodiment are described with reference to the drawings.

[First Effect]

As described above, each of the vehicle door locking devices disclosed in Patent Documents 1 and 2, there is a possibility that failure may occur during the motion of the inertia lever due to dust or water that enters through a striker intrusion and may remain and adhere to the inertia lever.

On the other hand, inertia part 60A of left side device 10A of the present embodiment is disposed below outer handle lever 52A, as illustrated in FIGS. 2A, 3, 4, 5A, and 5B. Therefore, in the present embodiment, even if dust or water adhere to inertia part 60A, this adherence is less likely to have any influence on a failure in motion of the inertia lever.

As described above, right side device 10B of the present embodiment has a symmetric relationship with left side device 10A (see FIGS. 3 and 4). Thus, like left side device 10A, right side device 10B of the present embodiment provides the present effect.

[Second Effect]

In addition, inertia part 60A included in left side device 10A of the present embodiment includes inertia lever 64A that swings about swing shaft 62A and weight 66A attached to inertia lever 64A, as illustrated in FIGS. 2A to 5B. As described above, an inertia force (a force condition for swinging) to act on inertia part 60A can be adjusted according to the type (the size, the weight, etc.) of weight 66A.

Therefore, in left side device 10A of the present embodiment, an inertia force to act on inertia part 60A can be adjusted through changing the type of weight 66A attached to inertia lever 64A. For example, in left side device 10A, the swinging condition of inertia 60A of left side device 10A can be set through changing the type of weight, taking into consideration such as the configuration and the strength of the left door. Note that the second effect is also provided by right side device 10B.

[Third Effect]

In addition, inertia part 60A included in left side device 10A of the present embodiment includes inertia lever 64A that swings about swing shaft 62A and torsion coil spring 68A that urges inertia lever 64A, as illustrated in FIGS. 2A to 5B. As described above, in order to an inertia force (a force condition for swinging) to act on inertia part 60A, the inertia force can be adjusted according to the type (the spring constant, etc.) of torsion coil spring 68A.

Therefore, in left side device 10A of the present embodiment, in order to an inertia force to act on inertia part 60A, the inertia force can be adjusted through type change of torsion coil spring 68A attached to inertia lever 64A. For example, in left side device 10A, the swinging condition of inertia 60A of left side device 10A can be set by changing the type of torsion coil spring 68A, taking into consideration of other conditions such as the configuration and the strength of the left door. Note that the third effect is also provided by right side device 10B.

[Fourth Effect]

In addition, inertia part 60A included in left side device 10A of the present embodiment has the same configuration, i.e., the same shape as that of inertia part 60B included in right side device 10B (see FIGS. 2B, 3, and 4).

Specifically, inertia lever 64A having weight 66A attached thereto is realized by inverting inertia lever 64B and attaching weight 66B from the rear surface side similarly into through hole 64B2. More specifically, in the present embodiment, inertia part 60A has a symmetric relationship with inertia part 60B (see FIGS. 2B, 3, and 4).

Therefore, in left side device 10A or right side device 10B of the present embodiment, by use of inertia lever 64A and weight 66A (or inertia lever 64B and weight 66B) of one of left side device 10A and right side device 10B of the present embodiment, the other device can be configured to provide the aforementioned first effect with ease or at low cost. Accordingly, door locking set 10 of the present embodiment can be configured to provide the aforementioned first effect with ease or at low cost.

[Fifth Effect]

In addition, when viewed from the front, housing 20A, (latch 30A and ratchet 40A included in) latch mechanism 25A, ratchet operating mechanism 50A, and the torsion coil spring that urges these components, which are included in left side device 10A of the preset embodiment, have a symmetric relationship with housing 20B, (latch 30B and ratchet 40B included in) latch mechanism 25B, ratchet operating mechanism 50B, and the torsion coil spring that urges these components, which are included in right side device 10B, respectively (see FIGS. 2B, 3, and 4).

Therefore, by use of one of left side device 10A and right side device 10B of the present embodiment, the other device can be configured to provide the aforementioned first effect with ease or at low cost. Accordingly, door locking set 10 of the present embodiment can be configured to provide the aforementioned first effect with ease or at low cost.

The present invention has been described above by exemplifying the aforementioned embodiment. However, embodiments within the technical scope of the present invention are not limited to the aforementioned embodiment. For example, embodiments described below are also within the technical scope of the present invention.

For example, as one example of doors having door locking set 10 attached thereto, the doors for respectively opening and closing openings AP1, AP2 on the front side of vehicle body CB that configures the vehicle having two-row seats have been described in the present embodiment. However, the doors having door locking set 10 attached thereto do not need to open and close openings AP1, AP2 on the front side of vehicle body CB. For example, such doors may be for opening and closing openings on the rear side of vehicle body CB.

Further, in the description of the present embodiment, portions, of inertia part 60A and inertia part 60B, which come into contact with outer handle levers 52A, 52B, are not inertia levers 64A, 64B, but weights 66A, 66B, respectively. However, a member, of inertia part 60A, which comes into contact with outer handle lever 52A may be inertia lever 64A as long as rotation of outer handle lever 52A at the predetermined angle or larger can be restricted as a result of change in orientation of the member that was caused to swing due to an external force of the predetermined magnitude or larger applied from the left side to the right side in the width direction of vehicle body CB. Also, a member, of inertia part 60B, which comes into contact with outer handle lever 52B may be inertia lever 64B as long as rotation of outer handle lever 52B at the predetermined angle or larger can be restricted as a result of change in orientation the member that was swing due to an external force of the predetermined magnitude or larger applied from the right side to the left side in the width direction of vehicle body CB.

Moreover, in the description of the present embodiment, inertia levers 64A, 64B are urged by the respective torsion coil springs. However, members other than the torsion coil springs may be used as long as the members can urge the levers in respective predetermined circumferential directions (rotational directions). For example, tension springs may be used.

Furthermore, in the description of the present embodiment, housing 20A, (latch 30A and ratchet 40A included in) latch mechanism 25A, ratchet operating mechanism 50A, and the torsion coil spring that urges these components, which are included in left side device 10A of the present embodiment, have a symmetric relationship with housing 20B, (latch 30B and ratchet 40B included in) latch mechanism 25B, ratchet operating mechanism 50B, and the torsion coil spring that urges these components, which are included in right side device 10B, respectively (see FIGS. 2B, 3, and 4). However, such a symmetric relationship may not be required as long as the components can exert the respective functions. The present modification also provides the first effect of the present embodiment.

Moreover, in the description of the present embodiment, inertia part 60A included in left side device 10A of the present embodiment has the same configuration, i.e., the same shape as that of inertia part 60B included in right side device 10B (see FIGS. 2B, 3, and 4). However, inertia part 60A does not need to have the same configuration, i.e., the same shape as that of inertia part 60B, as long as inertia part 60A and inertia part 60B are urged toward the center in the vehicle width direction and are capable of swinging toward the outside in the vehicle width direction. The present modification also provides the effects except for the fourth effect of the present embodiment.

Furthermore, in the description of the present embodiment, one end side in the width direction of vehicle body CB (or the vehicle) is defined as the left side whereas the other end side is defined as the right side. Further, in the description, left side device 10A is one example of a vehicle door locking device and right side device 10B is one example of the other vehicle door locking device under this condition. However, a condition contrary to the aforementioned condition, i.e., a condition in which the one end side in the width direction of vehicle body CB (or the vehicle) is defined as the right side whereas the other side is defined as the left side may be set. Left side device 10A is one example of the other vehicle door locking device and right side device 10B is one example of a vehicle door locking device under this condition.

Moreover, in the description of the present embodiment, left side device 10A and right side device 10B are configured to have a substantially symmetric (mirror-image) relationship (see FIGS. 2B, 3, and 4). Also, inertia lever 64B having weight 66B attached thereto and being included in right side device 10B is realized by inverting inertia lever 64A of left side device 10A and attaching weight 66A from the rear surface side similarly into through hole 64A2 (see FIGS. 2B, 3, and 4).

Here, in a modification of the present embodiment below, when a side collision is generated from the left door LD side relative to the vehicle, left side device 10A can prevent left door LD from opening and right side device 10B can prevent right door RD from opening. That is, while the portions of right side device 10B except for inertia part 60B are symmetric with those of left side device 10A, inertia lever 64A (hereinafter, referred to as inertia lever A) having weight 66A attached thereto in left side device 10A is supported by swing shaft 62B of right side device 10B in the same direction as that in left side device 10A. Further, inertia lever 64A attached to right side device 10B is urged by torsion coil spring 68A in the same direction as that in left side device 10A. In this case, when outer handle lever 52B is shifted from the orientation in FIG. 3 to the orientation in FIG. 4, a part of weight 66A of right side device 10B enters recess 52B3 formed in outer handle lever 52B. Thus, in right side device 10B of the present modification, inertia lever A normally does not come into contact with outer handle lever 52B. On the other hand, when an external force of the predetermined magnitude or larger acts from the left side to the right side in the vehicle width direction, inertia lever A swings at a predetermined angle counterclockwise, when viewed from the front, due to an inertia force caused by the external force. Specifically, weight 66A of inertia lever A comes into contact with the portion closer to swing shaft 52B1 than recess 52B3 in outer handle lever 52B.

Figure 5A:
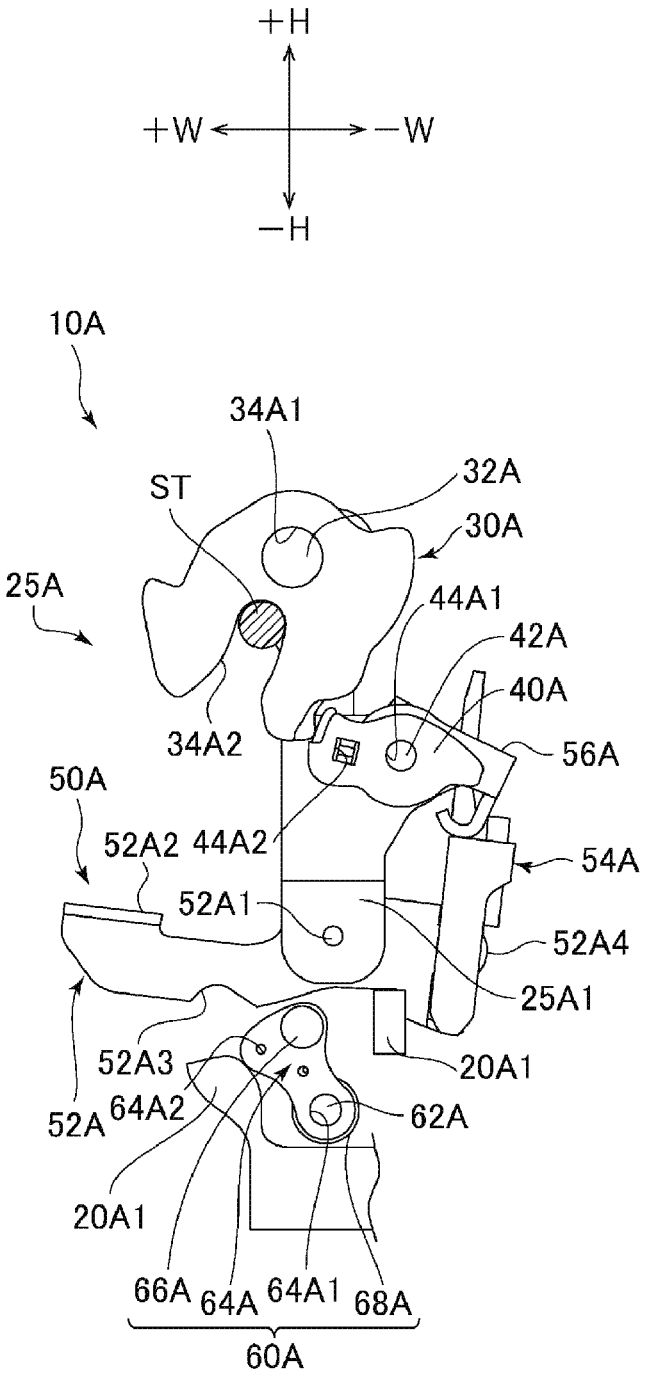
FIG. 5A is a front view of main components forming a door locking device for the left door of the present embodiment where a side collision has been from the left door side to the vehicle because the door locking device for the left door is in the engagement state.
Figure 5B:
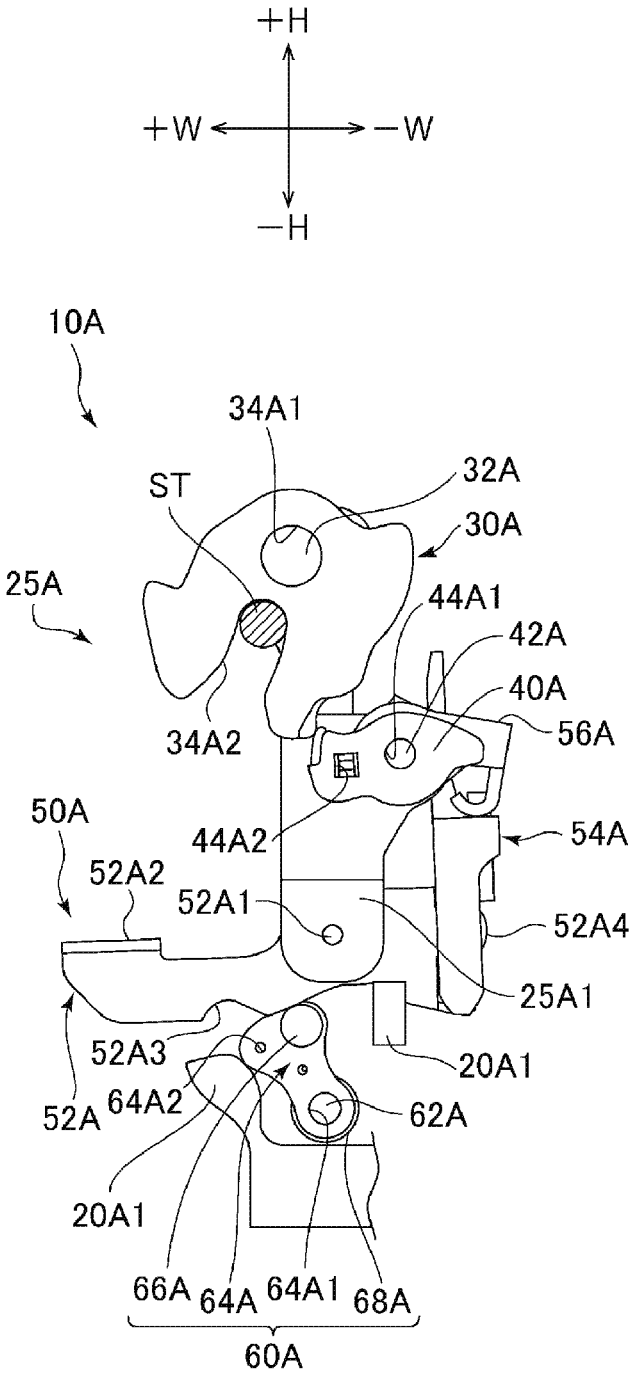
FIG. 5B is a front view of the main components forming the door locking device for the left door of the present embodiment wherein an outer handle lever has been further rotated after the state in FIG. 5A and rotation thereof is restricted by an inertia lever.

With the aforementioned configuration in the present modification, when a side collision is generated from the left door LD side of the vehicle, inertia part 60A of left side device 10A is changed to the orientation in FIG. 5A or 5B by an inertia force caused by the side collision, and thereby restricts rotation of outer handle lever 52A. Also, inertia lever A of right side device 10B is changed, by an inertia force caused by the side collision, to an orientation that causes it to come into contact with a portion closer to swing shaft 52B1 than recess 52B3 in outer handle lever 52B, and thereby restricts rotation of outer handle lever 52B.

Accordingly, in the present modification, when a side collision is generated from the left door LD side relative to the vehicle, left side device 10A can prevent left door LD from opening and right side device 10B can prevent right door RD from opening.

Moreover, in a modification of the present embodiment below, when a side collision is generated from the right door RD side relative to the vehicle, left side device 10A can prevent left door LD from opening and right side device 10B can prevent right door RD from opening. That is, while the portions of left side device 10A except for inertia part 60A are symmetric with those of right side device 10B, inertia lever 64B (hereinafter, referred to as inertia lever B) having weight 66B attached thereto in right side device 10B is supported by swing shaft 62A of left side device 10A in the same direction as that in right side device 10B. Further, inertia lever 64B attached to left side device 10A is urged by torsion coil spring 68B in the same direction as that in right side device 10B. In this case, when outer handle lever 52A is shifted from the orientation in FIG. 3 to the orientation in FIG. 4, a part of weight 66B of left side device 10A enters recess 52A3 formed in outer handle lever 52A. Thus, in left side device 10A of the present modification, inertia lever B normally does not come into contact with outer handle lever 52A. On the other hand, when an external force of the predetermined magnitude or larger acts from the right side to the left side in the width direction of the vehicle, inertia lever B swings at the predetermined angle clockwise, when viewed from the front, due to an inertia force caused by the external force. Specifically, weight 66B of inertia lever B comes into contact with a portion closer to swing shaft 52A1 than recess 52A3 in outer handle lever 52A.

Figure 5C:
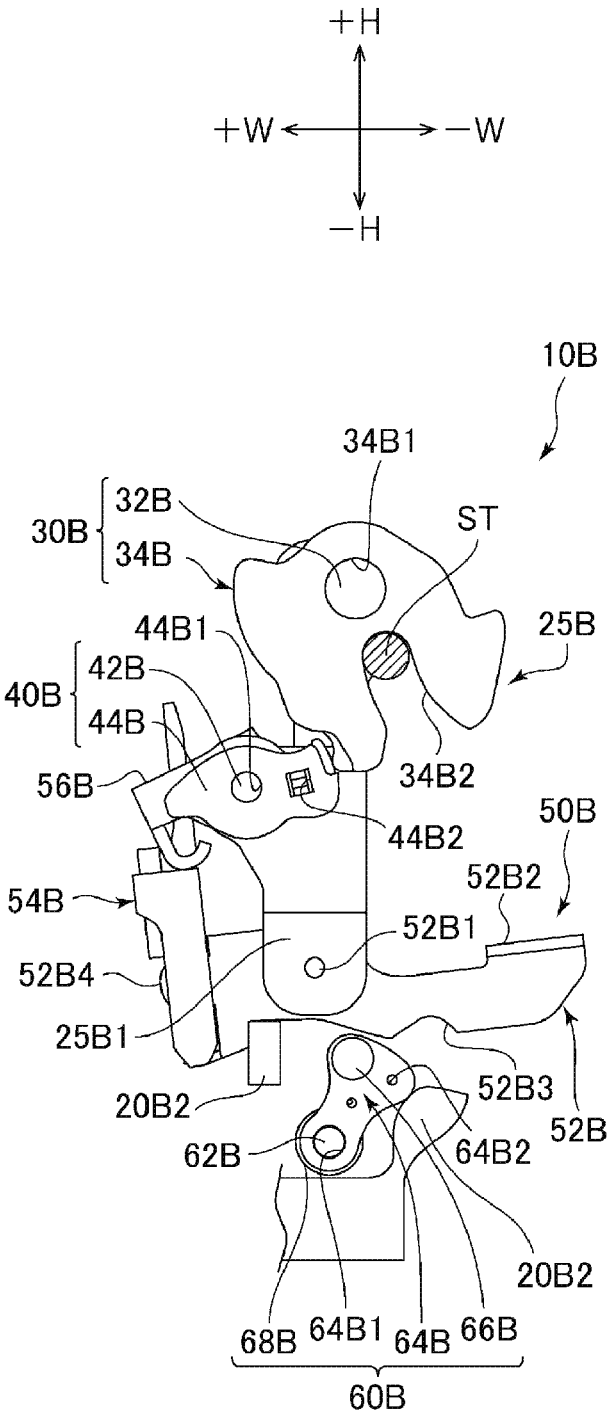
FIG. 5C is a front view of main components forming a vehicle door locking device for the right door of the present embodiment where a side collision has been from the right door side to the vehicle because the door locking device for the right door is in the engagement state.

With the aforementioned configuration, in the present modification, when a side collision is generated from the right door RD side relative to the vehicle, inertia part 60B of right side device 10B is shifted to the orientation in FIG. 5C by an inertia force caused by the side collision, and thereby restricts rotation of outer handle lever 52B. Also, inertia lever B of left side device 10A is changed, by an inertia force caused by the side collision, to an orientation that causes it to come into contact with a portion closer to swing shaft 52A1 than recess 52A3 in outer handle lever 52A, and thereby restricts rotation of outer handle lever 52A.

Accordingly, in the present modification, when a side collision is generated from the right door RD side relative to the vehicle, left side device 10A can prevent left door LD from opening and right side device 10B can prevent right door RD from opening.

REFERENCE SIGNS LIST

10 vehicle door locking set
10A left side device (one example of a vehicle door locking device)
10B right side device (one example of a vehicle door locking device)
20A housing
20B housing (one example of an other housing)
30A latch
30B an other latch
40A ratchet
40B an other ratchet
52A outer handle lever
52B outer handle lever (one example of an other outer handle lever)
60A inertia part
60B an other inertia part
64A inertia lever
66A weight
68A torsion coil spring (one example of an urging member)
68B torsion coil spring (one example of an other urging member)
AP1 opening on one end side in width direction of vehicle body
AP2 opening on the other end side in width direction of vehicle body
LD door
RD an other door
ST striker

What is claimed is:

1. A vehicle door locking set comprising:

a first vehicle door lock disposed on a first side of a vehicle body in a width direction thereof; and a second vehicle door lock disposed on a second side of the vehicle body in the width direction thereof, wherein the first vehicle door lock comprises:

a first latch system fixed to a first door that opens and closes a first opening on the first side, the first latch system comprising:

a first case to which a first latch is attached, the first latch being swingable relative to the first case, the first latch locking a first striker fixed to the vehicle body when having a latching orientation in conjunction with opening and closing of the first door, and releasing the first striker when being shifted from the latching orientation to an unlatching orientation; and a first ratchet that is swingable relative to the first case, that, when having a first orientation, comes into contact with the first latch and holds the first latch in the latching orientation, and that, when being shifted from the first orientation to a second orientation, leaves the first latch and shifts the first latch from the latching orientation to the unlatching orientation;

a first outer handle lever that is swingably supported by the first case, that is connected to a first outer handle, and that is rotated in conjunction with an opening operation of the first outer handle; and a first inertia part that is swingably supported below the first outer handle lever, wherein an orientation of the first inertia part is maintained by being in contact with the first case while being urged by a first urging member toward the first case, and when an external force of a predetermined magnitude or larger acts on the first inertia part from the first side toward the second side, the orientation of the first inertia part is changed by an inertia force caused by the external force, and thereby restricts rotation of the first outer handle lever, wherein the second vehicle door lock comprises:

a second latch system fixed to a second door that opens and closes a second opening on the second side, the second latch system comprising:

a second case to which a second latch is attached, the second latch being swingable relative to the second case, the second latch locking a second striker fixed to the vehicle body when having a latching orientation in conjunction with opening and closing of the second door, and releasing the second striker when being shifted from the latching orientation to an unlatching orientation; and a second ratchet that is swingable relative to the second case, that, when having a third orientation, comes into contact with the second latch and holds the second latch in the latching orientation, and that, when being shifted from the third orientation to a fourth orientation, leaves the second latch and shifts the second latch from the latching orientation to the unlatching orientation;

a second outer handle lever that is swingably supported by the second case, that is connected to a second outer handle, and that is rotated in conjunction with an opening operation of the second outer handle; and a second inertia part that is swingably supported below the second outer handle lever, wherein an orientation of the second inertia part is maintained by being in contact with the second case while being urged by a second urging member toward the second case, and when an external force of a predetermined magnitude or larger acts on the second inertia part from the second side toward the first side, the orientation of the second inertia part is changed by an inertia force caused by the external force, and thereby restricts rotation of the second outer handle lever, and wherein the first inertia part has a first inertia lever having a first weight, two first lateral through holes for fixing the first weight to the first inertia lever and a first pivot through hole through which the first inertia part is swingably supported, and the second inertia part has a second inertia lever having a second weight, two second lateral through holes for fixing the second weight to the second inertia lever and a second pivot through hole through which the second inertia part is swingably supported, the first weight is fixed in only one of the first lateral through holes that is an innermost first lateral through hole in the width direction of the vehicle body, and the second weight is fixed in only one of the second lateral through holes that is an innermost second lateral through hole in the width direction of the vehicle body.

2. The vehicle door locking device according to claim 1, wherein the first inertia part has a symmetric relationship with the second inertia part, when viewed from a longitudinal direction of the vehicle body.

3. The vehicle door locking set according to claim 1, wherein the first case, the first latch, the first ratchet, and the first outer handle lever have symmetric relationships with the second case, the second latch, the second ratchet, and the second outer handle lever, respectively, when viewed from a longitudinal direction of the vehicle body.

4. The vehicle door locking set according to claim 1, wherein the first inertia part includes a first swing shaft for swingably supporting the first inertia lever, and the second inertia part includes a second swing shaft for swingably supporting the second inertia lever, wherein the first swing shaft and the second swing shaft have a same shape, the first inertia lever and the second inertia lever have a same shape, and the first weight and the second weight have a same shape.

5. The vehicle door locking set according to claim 1, wherein the first and the second lateral through holes are configured to selectively accept the respective weights.

* * * * *